US008403544B1

(12) United States Patent
Wu et al.

(10) Patent No.: US 8,403,544 B1
(45) Date of Patent: Mar. 26, 2013

(54) LAMP AND LAMP COVER LATCHING STRUCTURE

(75) Inventors: Yu-Chia Wu, Miao-Li (TW); Ping-Jung Tsai, Miao-Li (TW)

(73) Assignee: Foxsemicon Integrated Technology, Inc., Chu-Nan, Miao-Li Hsien (TW)

( * ) Notice: Subject to any disclaimer, the term of this patent is extended or adjusted under 35 U.S.C. 154(b) by 0 days.

(21) Appl. No.: 13/300,660

(22) Filed: Nov. 21, 2011

Related U.S. Application Data

(66) Substitute for application No. 12/913,778, filed on Oct. 28, 2010, now abandoned.

(51) Int. Cl.
*F21V 21/00* (2006.01)

(52) U.S. Cl. ..... 362/374; 362/581; 362/362

(58) Field of Classification Search ..... 362/581, 362/362, 374
See application file for complete search history.

(56) References Cited

U.S. PATENT DOCUMENTS 3,093,322 A * 6/1963 Boutelle ..... 362/147
6,998,650 B1 * 2/2006 Wu ..... 257/100

* cited by examiner

*Primary Examiner* — Vip Patel
(74) *Attorney, Agent, or Firm* — Altis Law Group, Inc.

(57) ABSTRACT

A lamp includes a housing, a lamp cover with a hook, a light source, and a lamp cover latching structure. The light source is disposed between the housing and the lamp cover. The lamp cover latching structure includes a securing portion, a latching portion, and a pressing portion. The securing portion is fixed to the housing. The latching portion is capable of latching with the latching hook. The latching portion is capable of separating from the latching hook by pressing the pressing portion.

18 Claims, 5 Drawing Sheets

LAMP AND LAMP COVER LATCHING STRUCTURE

BACKGROUND

1. Technical Field

The present disclosure relates to lamps and, particularly, to a lamp cover latching structure for a lamp.

2. Description of Related Art

Generally, a lamp includes a housing with a light exiting opening, a light source received in the housing, and a lamp cover covering the light exiting opening of the housing. The lamp cover is configured for protecting the light source, and is usually secured on the housing by screws etc.. As a result, the lamp cover is difficult to be assembled onto the housing and disassembled from the housing, and the light source received in the housing is inconvenient to be maintained or replaced if it is damaged.

What is needed is a lamp cover latching structure which can ameliorate the problem of the prior art.

BRIEF DESCRIPTION OF THE DRAWINGS

Many aspects of the present lamp and lamp cover latching structure can be better understood with reference to the accompanying drawings. The components in the drawings are not necessarily drawn to scale, the emphasis instead being placed upon clearly illustrating the principle of the lamp and lamp cover latching structure. In the drawings, all the views are schematic.

DETAILED DESCRIPTION

Embodiments of the present disclosure will now be described in detail below, with reference to the accompanying drawings.

Figure 1:
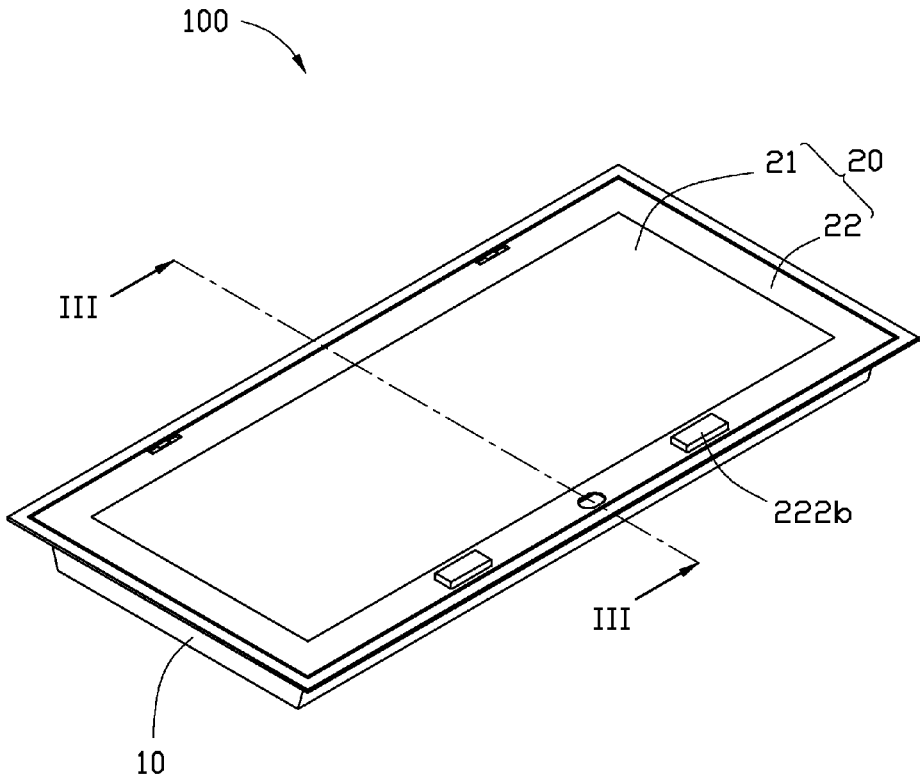
FIG. 1 is a schematic view of a lamp with a lamp cover which is closed according to a first exemplary embodiment.
Figure 2:
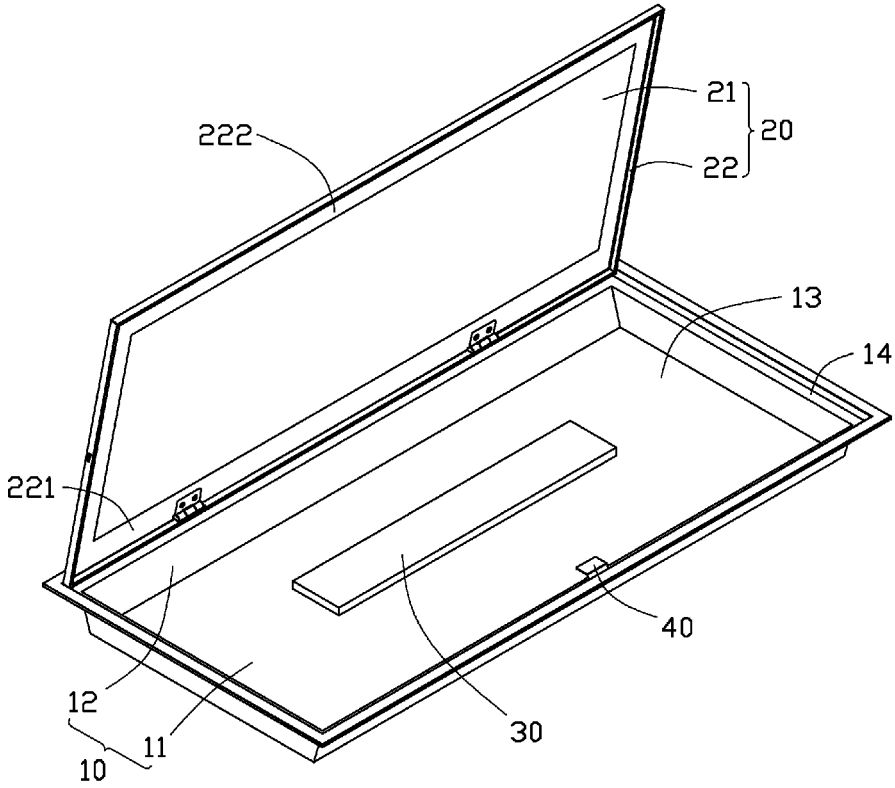
FIG. 2 is a schematic view of the lamp of FIG. 1 with the lamp cover being opened.

Referring to FIGS. 1 and 2, a lamp 100 according to a first exemplary embodiment is shown. The lamp 100 includes a housing 10, a lamp cover 20, a light source 30, and a lamp cover latching structure 40.

The housing 10 includes a bottom wall 11 and at least one sidewall 12. The bottom wall 11 can be round, rectangular, triangular etc.. In the present embodiment, the bottom wall 11 is rectangular, and the housing 10 includes four sidewalls 12. The bottom wall 11 and the sidewalls 12 cooperatively define a receiving space 13. The light source 30 is received in the receiving space 13. The housing 10 defines a light exiting opening 14 opposite to the bottom wall 11.

The lamp cover 20 covers the light exiting opening 14 of the housing 10.

The shape of the lamp cover 20 is determined in accordance with the shape of the light exiting opening 14 of the housing 10. The lamp cover 20 can be round, rectangular, triangular etc. In the present embodiment, the lamp cover 20 is rectangular, and the lamp cover 20 includes a transparent portion 21 and a frame 22 surrounding the transparent portion 21. The frame 22 includes a first border 221 and a second border 222 opposite to the first border 221. The first border 221 of the frame 22 is pivotably connected to a sidewall 12 of the housing 10. The first border 221 is pivotably connected to the sidewall 12 by hinges (not labeled). The second border 222 of the frame 22 includes a latching hook **222*a* (see FIG. 3) extending towards the bottom wall 11 of the housing 10. The second border 222 further includes a holding portion 222*b* formed on an outer surface of the second border 222 facing away from the bottom wall 11. The holding portion 222*b* can be used as a handle by a user for manipulating the lamp cover 20 to be closed or opened. The frame 22 can be made of transparent material or opaque material. If the frame 22 is made of transparent material, the frame 22 can be integrally formed with the transparent portion 21** as a single piece.

The light source 30 is received between the housing 10 and the lamp cover 20. In the present embodiment, the light source 30 is secured on the bottom wall 11 of the housing 10. It is understood that the shape of the housing 10 and the shape the lamp cover 20 are not limited to the present embodiment; for example, in other embodiments, the housing 10 can be a flat plate, and an inner surface of the lamp cover 20 facing towards the housing 10 can be a concave surface.

Figure 3:
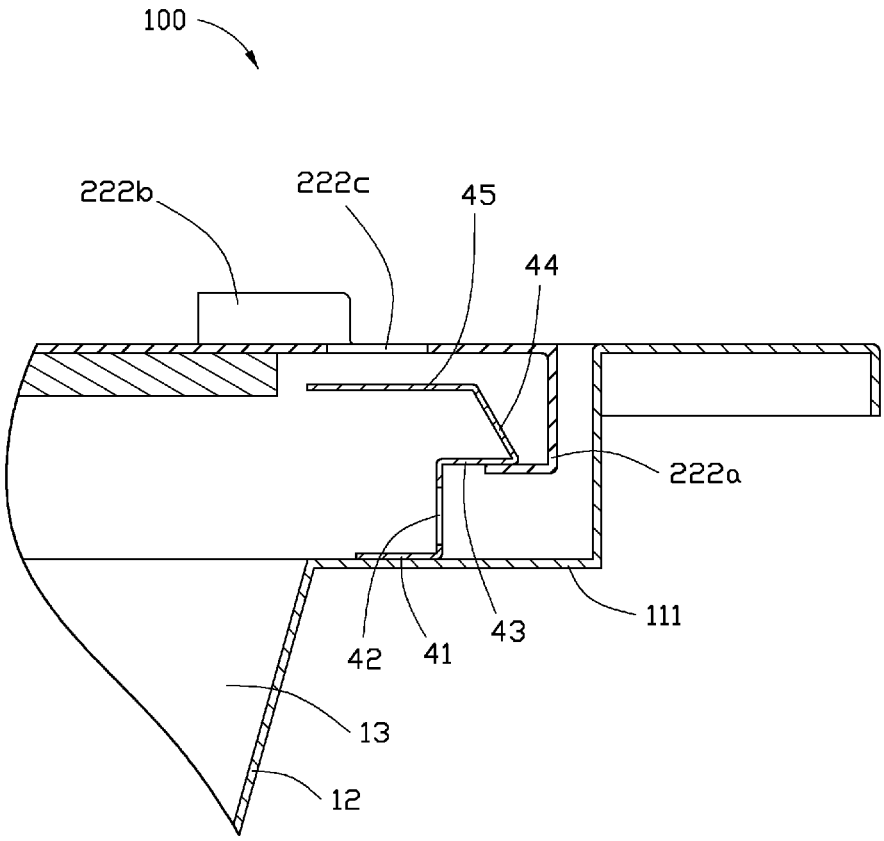
FIG. 3 is a partial, cross sectional view of the lamp taken along line III-III of FIG. 1.
Figure 4:
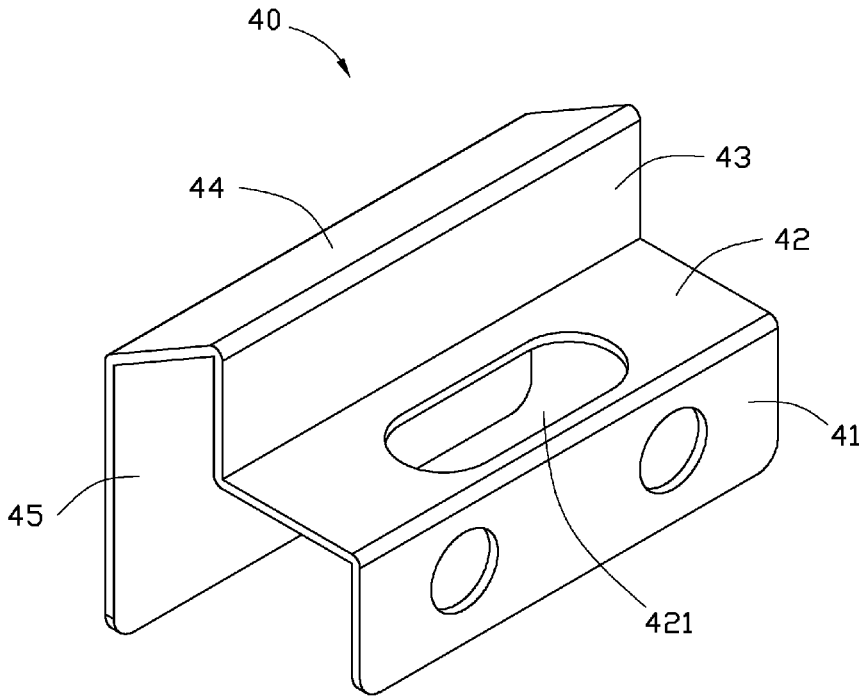
FIG. 4 is a schematic view of a lamp cover latching structure of the lamp of FIG. 1.

Referring to FIGS. 3 to 4, the lamp cover latching structure 40 is fixed on the sidewall 12 of the housing 10. The lamp cover latching structure 40 is configured for engaging with the latching hook **222*a* of the lamp cover 20 to fix the lamp cover 20 at the closed position. In the present embodiment, the lamp cover latching structure 40 is an elastic sheet. The lamp cover latching structure 40 includes a securing portion 41, a first connecting portion 42, a latching portion 43, a second connecting portion 44, and a pressing portion 45. The securing portion 41, the first connecting portion 42, the latching portion 43, the second connecting portion 44, and the pressing portion 45 are connected together in sequence. Preferably, the securing portion 41, the first connecting portion 42, the latching portion 43, the second connecting portion 44, and the pressing portion 45** are integrally formed as a single piece.

The securing portion 41 is fixed to the sidewall 12 of the housing 10. In order that the securing portion 41 can be fixed on the sidewall 12 conveniently, in the present embodiment, the sidewall 12 includes a step portion 111 parallel to the bottom wall 11 of the housing 10, and the securing portion 41 is fixed on the step portion 111.

The first connecting portion 42 extends from an outer end of the securing portion 41 along a direction away from the bottom wall 11. In the present embodiment, the first connecting portion 42 is perpendicular to the step portion 111. The first connecting portion 42 includes an inner side facing towards the first border 221 of the lamp cover 20 and an outer side opposite to the inner side. The latching portion 43 extends outwardly from a top end of the first connecting portion 42 to be located outside the outer side of the first connection portion 42. The pressing portion 45 extends inward from a top end of the second connecting portion 44 to a position inside the inner side of the first connecting portion 42.

The latching portion 43 has one end connected to the first connecting portion 42, and an opposite end away from the first connecting portion 42 connected to an end of the pressing portion 45 located outside the outer side of the first connecting portion 42 via the second connecting portion 44. The latching portion 43 is configured for latching with the latching hook **222*a*. In the present embodiment, the latching portion 43 is perpendicular to the first connecting portion 42. Preferably, an angle formed by the latching portion 43 and the second connecting portion 44 is an acute angle; thus, the latching hook 222***a* can latch with the latching portion 43 conveniently.

When the pressing portion 45 is pressed, the first connecting portion 42 will be distorted, the latching portion 43 will be separated from the latching hook 222*a*, and the lamp cover 20 can be opened conveniently. The frame 22 defines a through hole 222*c* corresponding to the pressing portion 45; so, a finger or a tool such as a screwdriver or a rod can be inserted into the through hole 222*c* to press the pressing portion 45. In order to decrease the force needed to be applied on the pressing portion 45, in the present embodiment, the first connecting portion 42 further defines a hole 421; thus, the first connecting portion 42 is more flexible and can be distorted by a relatively small force. In the present embodiment, because the pressing portion 45 is located between the lamp cover 20 and the housing 10, an accident opening of the lamp cover 20 can be avoided.

It is understood, the connection between the first border 221 of the lamp cover 20 and the sidewall 12 of the housing 10 is not limited to the present embodiment, for example, in other embodiments, the first border 221 of the lamp cover 20 can also be connected to the sidewall 12 of the housing 10 by several of the lamp cover latching structure 40 and the latching hook 222*a*.

Figure 5:
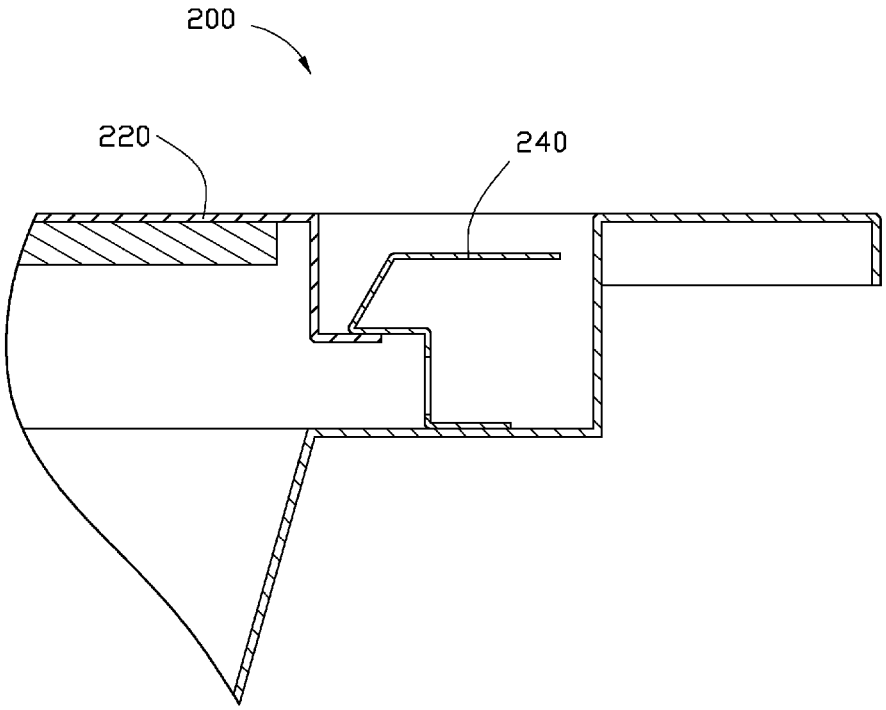
FIG. 5 is a partial, cross sectional view of a lamp according to a second exemplary embodiment.

Referring to FIG. 5, a lamp 200 according to a second exemplary embodiment is shown. The lamp 200 is similar to the lamp 100 of the first exemplary embodiment, and the differences between the lamp 200 and the lamp 100 is that: the lamp 200 includes a lamp cover 220 and a lamp cover latching structure 240, wherein, the lamp cover latching structure 240 is located outside of the lamp cover 220; thus, the lamp cover 220 needs not to define a through hole corresponding to the lamp cover latching structure 240.

While certain embodiments have been described and exemplified above, various other embodiments will be apparent to those skilled in the art from the foregoing disclosure. The disclosure is not limited to the particular embodiments described and exemplified, and the embodiments are capable of considerable variation and modification without departure from the scope and spirit of the appended claims.

What is claimed is:

1. A lamp cover latching structure for a lamp, the lamp comprising a lamp cover and a housing, the lamp cover comprising, a latching, hook, the lamp cover latching structure engageable to the latching hook, the lamp cover latching structure comprising:

a securing portion fixed to the housing;

a latching portion capable of latching with the latching hook; and a pressing portion, the latching portion being capable of separating from the latching hook when the pressing portion is pressed;

wherein the latching hook is extended inwardly under the latching portion when the latching hook is engaged and latched to the latching portion of the lamp cover latching structure.

2. The lamp cover latching structure as claimed in claim 1 further comprising a first connecting portion and a second connecting portion, wherein the lamp cover latching structure is an elastic sheet, and the securing portion, the first connecting portion, the latching portion, the second connecting portion, and the pressing portion are connected together in sequence.

3. The lamp cover hatching structure as claimed in claim 2, wherein the securing portion, the first connecting portion, the latching portion, the second connecting portion, and the pressing portion are integrally formed as a single piece.

4. The lamp cover latching structure as claimed in claim 2 wherein the first connecting portion extends from an end of the securing portion along a direction away from the housing, the latching portion extends outwardly horn an end of the first connecting portion distant from the securing portion and the pressing portion extends inwardly from an end of the second connecting portion distant from the latching portion.

5. The lamp cover latching structure as claimed in claim 4, wherein the latching portion has one end connected to the first connecting portion, and an opposite end away from the first connecting portion connected to an outer end of the pressing portion via the second connecting portion.

6. The lamp cover latching structure as claimed in claim 5, wherein an angle formed by the latching portion and the second connecting portion is an acute angle.

7. The lamp cover latching structure as claimed in claim 5, wherein the first connecting portion further defines a bole therein to increase a flexibility of the first connection portion.

8. The lamp cover latching structure as claimed in claim 5, wherein the latching portion is perpendicular to the first connecting portion.

9. A lamp comprising:

a housing;

a lamp cover with a latching hook;

a light source disposed between the housing and the lamp cover; and a lamp cover latching structure, the lamp cover latching structure engageable to the latching hook, the lamp cover latching structure comprising:

a securing portion fixed to the housing;

a latching portion capable of latching with the latching hook, wherein when the latching portion and the latching hook are engaged and latched together the latching hook extends inwardly under the latching portion of the lamp cover latching structure; and a pressing portion, the latching portion being capable of separating from the latching hook by pressing the pressing portion.

10. The lamp as claimed in claim 9, wherein the lamp cover comprising two opposite ends, one end is connected to the housing by the lamp cover latching structure, and the other end is pivotably connected to housing.

11. The lamp as claimed in claim 9, wherein the pressing portion is received between the housing and the lamp cover, and the lamp cover defines a through hole corresponding to the pressing portion.

12. The lamp as claimed in claim 9, wherein the lamp cover latching structure further comprises a first connecting portion and a second connecting portion, the lamp cover latching structure is an elastic sheet, and the securing portion, the first connecting portion, the latching portion, the second connecting portion, and the pressing portion are connected together in sequence.

13. The lamp as claimed in claim 12, wherein the securing portion, the first connecting portion, the latching portion, the second connecting portion, and the pressing portion are integrally formed as a single piece.

14. The lamp as claimed in claim 12, wherein first connecting portion extends from an outer end of the securing portion along a direction away from the housing, the pressing portion is extended to a position inside the first connection portion and the latching portion is located outside the first connecting portion.

15. The lamp as claimed in claim 14, wherein the latching portion has one end connected to the first connecting portion, and an opposite end away from the first connecting portion connected to an outer end of the pressing portion via the second connecting portion.

16. The lamp as claimed in claim 15, wherein an angle formed by the latching, portion and the second connecting portion is an acute angle.

17. The lamp as claimed in claim 15, wherein the first connecting portion further defines a hole therein to increase a flexibility thereof.

18. The lamp as claimed in claim 15, wherein the latching portion is perpendicular to the first connecting portion.

* * * * *